US011539136B1

(12) United States Patent
Nam et al.

(10) Patent No.: US 11,539,136 B1
(45) Date of Patent: Dec. 27, 2022

(54) ANTENNA DEVICE COMPRISING RADIATOR FOR NARROWBAND AND RADIATOR FOR WIDEBAND

(71) Applicant: KYOCERA AVX Components Gunpo Co., Ltd., Gunpo-si (KR)

(72) Inventors: Sung Soo Nam, Suwon-si (KR); Cheong Ho Ryu, Yongin-si (KR); Jin Hyuk Jang, Suwon-si (KR); Hyung Jin Kim, Gunpo-si (KR)

(73) Assignee: KYOCERA AVX Components Gunpo Co., Ltd., Gunpo-si (KR)

( * ) Notice: Subject to any disclaimer, the term of this patent is extended or adjusted under 35 U.S.C. 154(b) by 0 days.

(21) Appl. No.: 17/830,089

(22) Filed: Jun. 1, 2022

(30) Foreign Application Priority Data

Jun. 2, 2021 (KR) ..... 10-2021-0071807

(51) Int. Cl.

| | |
|---|---|
| ***H01Q 21/00*** | (2006.01) |
| ***H01Q 5/50*** | (2015.01) |
| ***H01Q 1/52*** | (2006.01) |
| ***H01Q 5/35*** | (2015.01) |
| ***H01Q 13/10*** | (2006.01) |
| ***H01Q 5/371*** | (2015.01) |
| ***H01Q 9/40*** | (2006.01) |

(52) U.S. Cl.
CPC ..... *H01Q 5/50* (2015.01); *H01Q 1/52* (2013.01); *H01Q 5/35* (2015.01); *H01Q 5/371* (2015.01); *H01Q 9/40* (2013.01); *H01Q 13/10* (2013.01)

(58) Field of Classification Search
CPC .. H01Q 5/50; H01Q 1/52; H01Q 5/35; H01Q 5/371; H01Q 9/40; H01Q 13/10
See application file for complete search history.

(56) References Cited

U.S. PATENT DOCUMENTS

2005/0030232 A1* 2/2005 Monebhurrun ..... H01Q 9/16 343/702
2011/0032155 A1* 2/2011 Yanagi ..... H01Q 1/48 343/700 MS

FOREIGN PATENT DOCUMENTS

KR 10-2013-0023669 A 3/2013
KR 10-2014-0128193 A 11/2014
KR 10-2015-0076719 A 7/2015

OTHER PUBLICATIONS

Korean Office Action dated Oct. 25, 2021, corresponding to Korean Patent Application No. 10-2021-0071807; 11 pages (with English Translation).

(Continued)

*Primary Examiner* — Dieu Hien T Duong
(74) *Attorney, Agent, or Firm* — Maier & Maier, PLLC

(57) ABSTRACT

The antenna device includes a substrate, a first radiator that is in a plane shape, operates as a wideband antenna, and is disposed on the dielectric region such that one end portion faces the ground region and an opposite end portion faces away from the ground region, a width of the opposite end portion being wider than a width of the one end portion, a second radiator that is in a line shape, operates as a narrowband antenna and at a lower frequency than the first radiator, and is disposed adjacent to the first radiator on the dielectric region such that one end portion faces the ground region and an opposite end portion faces away from the ground region, a first feeding line, a second feeding line, and a connecting structure connected with the first radiator, the first feeding line, the second radiator, and the second feeding line.

9 Claims, 11 Drawing Sheets

(56) References Cited

OTHER PUBLICATIONS

Notice of Allowance dated Jan. 25, 2022, corresponding to Korean Patent Application No. 10-2021-0071807; 6 pages (with English Translation).
Korean Office Action dated Oct. 25, 2021, corresponding to Korean Patent Application No. 10-2021-0071807; 7 pages (with English Translation).

* cited by examiner

ANTENNA DEVICE COMPRISING RADIATOR FOR NARROWBAND AND RADIATOR FOR WIDEBAND

CROSS-REFERENCE TO RELATED APPLICATION(S)

This application is based on and claims priority under 35 U.S.C. § 119 to Korean Patent Application No. 10-2021-0071807, filed on Jun. 2, 2021, in the Korean Intellectual Property Office, the disclosure of which is incorporated by reference herein its entirety.

BACKGROUND

The disclosure relates to an antenna device of a structure for reducing the interference between a wideband antenna radiator and a narrowband antenna radiator.

A wireless communication technology may make it possible to transmit/receive various types of information. The wireless communication technology is being developed to transmit/receive more information faster and to provide various services by grafting various communication technologies. An antenna device is essentially required to implement a communication device to which the communication technology is applied. In particular, a plurality of antennas capable of servicing different communication bands may be required depending on a communication module combined in the communication device. When the plurality of antennas are disposed adjacent to each other, the radiation may become unstable due to the interference between antennas, thereby causing the reduction of radiation performance. Accordingly, there is required a technology for improving the radiation performance by reducing the interference between the plurality of antennas.

SUMMARY

When a communication device developed by a combination of various communication modules is not an integrated communication module, there is a need to separate input terminals of antennas. In this case, the interference may occur between two or more antennas, which may adversely affect the performance of communication. To prevent the interference of two or more antennas, there may be used a way to arrange antennas so as to be separated as much as a given distance or a way to arrange radiation patterns so as cross each other. However, the above way may require an additional space in addition to the space where antennas are disposed. That is, it is difficult to miniaturize an antenna device. To solve the above issue, an interference preventing device may be applied; in this case, the difficulty of implementing the interference preventing device may be high, and the interference preventing device may be used only under a special condition.

Aspects of the disclosure are to address at least the above-mentioned problems and/or disadvantages and to provide at least the advantages described below. Accordingly, an aspect of the disclosure is to provide an antenna device of a structure capable of effectively reducing the interference occurring between a plurality of antennas.

In accordance with an aspect of the disclosure, an antenna device which includes a wideband antenna radiator and a narrowband antenna radiator may include a substrate that includes a ground region and a dielectric region, a first radiator that is in a plane shape, operates as a wideband antenna, and is disposed on the dielectric region such that one end portion faces the ground region and an opposite end portion faces away from the ground region, a width of the opposite end portion being wider than a width of the one end portion, a second radiator that is in a line shape, operates as a narrowband antenna and at a lower frequency than the first radiator, and is disposed adjacent to the first radiator on the dielectric region such that one end portion faces the ground region and an opposite end portion faces away from the ground region, a first feeding line that is disposed on the ground region, a second feeding line that is disposed on the ground region, and a connecting structure that is connected with the first radiator, the first feeding line, the second radiator, and the second feeding line, and the connecting structure may operate as an open circuit when radiation is made by the second radiator.

In an embodiment, the first radiator may be in a semicircular or semielliptical shape inducing a change in impedance by a distance between the first radiator and the ground region depending on a distance from a feeding point of the first radiator, and the second radiator may be in a straight line shape.

In an embodiment, the second radiator may be in the shape of a line bent one or more times.

In an embodiment, a selectivity of the first radiator may be 4 or less, and a selectivity of the second radiator may be 30 or less.

In an embodiment, the first radiator and the second radiator may operate in a first-order resonant mode and may form an omnidirectional radiation pattern.

In an embodiment, a portion of the connecting structure may overlap the first radiator, when viewed from above an upper surface of the substrate.

In an embodiment, a length of the connecting structure may be ¼ or more of a guided wavelength ($\lambda g$) corresponding to a resonant frequency of the second radiator and a relative dielectric constant of a dielectric contacting the second radiator and may be ¼ or less of a wavelength ($\lambda$) corresponding to a resonant frequency of the second radiator.

In an embodiment, when radiation is made by the second radiator, the connecting structure may operate as an open circuit.

In an embodiment, when radiation is made by the first radiator, a feeding current may be transferred to the second radiator through the connecting structure and may be fed back to the first radiator through the connecting structure without radiation by the second radiator.

In an embodiment, the antenna device may further include a dielectric plate disposed on the dielectric region, a dielectric constant of the dielectric plate may be greater than a dielectric constant of the dielectric region, the first radiator and the second radiator may be disposed on the dielectric plate, and the connecting structure may be interposed between the dielectric region and the dielectric plate.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Figure 1:
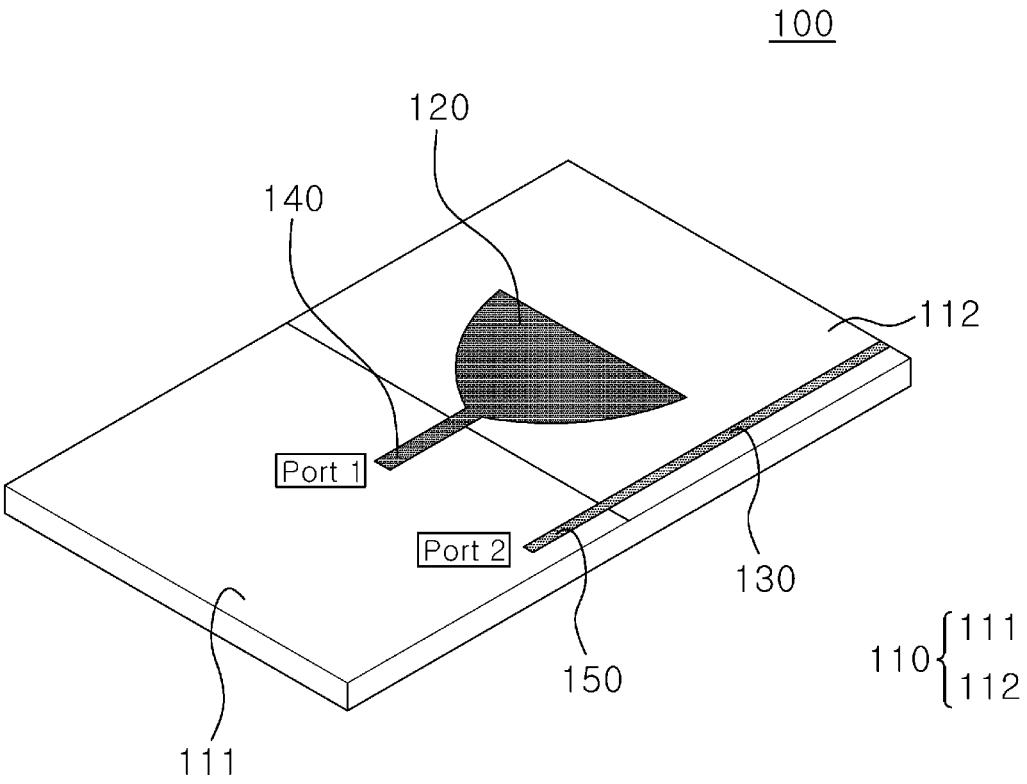
FIG. 1 is a perspective view of an antenna device according to an embodiment.

With regard to description of drawings, the same or similar components will be marked by the same or similar reference signs.

DETAILED DESCRIPTION

Below, some embodiments of the present disclosure will be described in detail with reference to the accompanying drawings. However, those of ordinary skill in the art will recognize that the modification, equivalent, and/or alternative on various embodiments described herein can be variously made without the limitation to a specific embodiment of the present disclosure. In adding reference numerals to components of each drawing, it should be noted that the same components are given the same reference numerals as much as possible even though they are illustrated in different drawings. In addition, in describing embodiments of the present disclosure, the detailed description associated with well-known components or functions will be omitted when it is determined as obstructing the understanding of the embodiments of the present disclosure.

Figure 2:
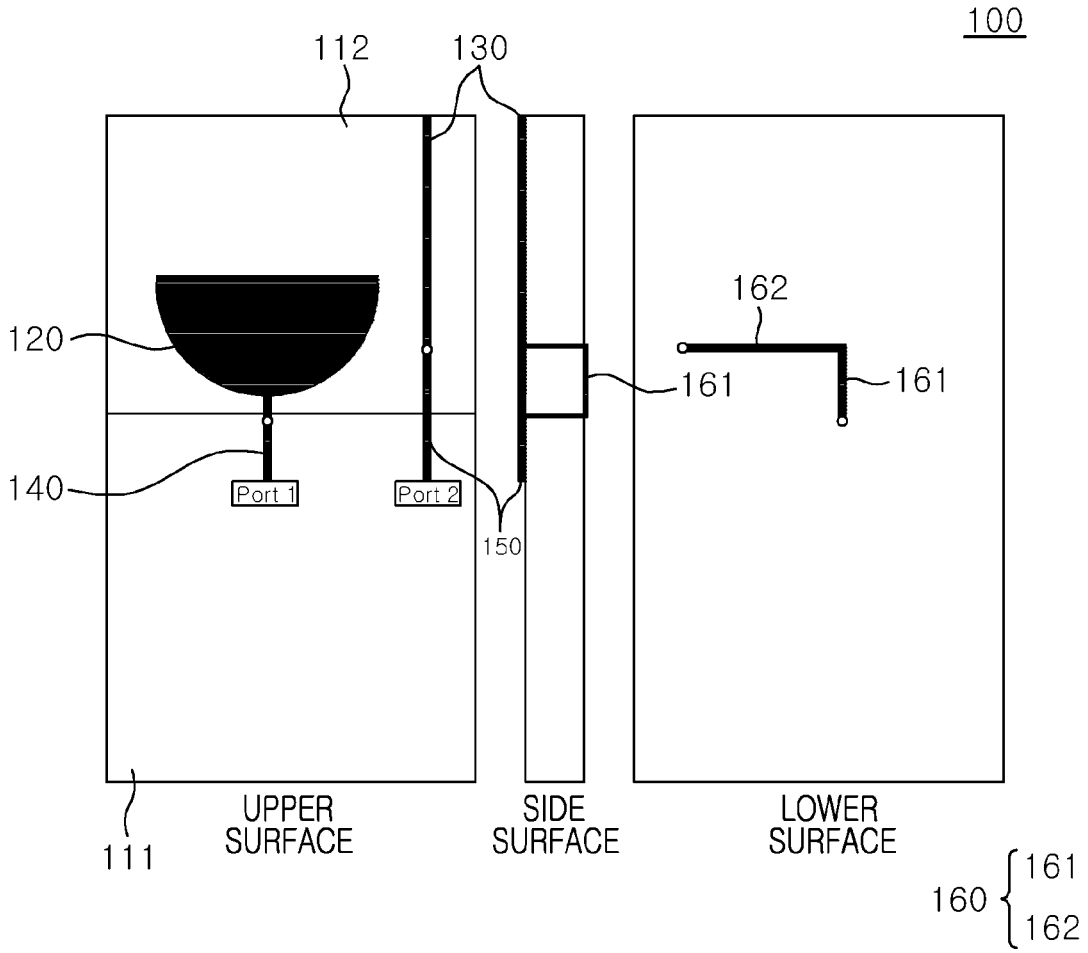
FIG. 2 is a view illustrating a front surface and a side surface of an antenna device according to an embodiment.

FIG. 1 is a perspective view of an antenna device according to an embodiment. FIG. 2 is a view illustrating a front surface and a side surface of an antenna device according to an embodiment.

Referring to FIG. 1, an antenna device 100 including a wideband antenna radiator and a narrowband antenna radiator according to an embodiment may include a substrate 110, a first radiator 120, a second radiator 130, a first feeding line 140, a second feeding line 150, and a connecting structure 160. The antenna device 100 may be implemented to cover a first band and a second band. A frequency of the first band may be higher than a frequency of the second band, the first band may be implemented to be a wide band, and the second band may be implemented to be a narrow band.

The substrate 110 may be in the shape of a plate. For example, the substrate 110 may be rectangular. The substrate 110 may include a ground region 111 and a dielectric region 112. For example, half of the substrate 110 may be formed of the ground region 111, and the other half of the substrate 110 may be formed of the dielectric region 112. The ground region 111 may be formed of a conductor and a dielectric, and the dielectric region 112 may be formed of a dielectric without a conductor. The first feeding line 140, the second feeding line 150, a communication circuit (not illustrated), and the like may be disposed on the ground region 111, and the first radiator 120, the second feeding line 150, the connecting structure 160, and the like may be disposed on the dielectric region 112. In the specification, the expression "a first component is disposed on a second component" may be interpreted as including both the case where the first component is directly disposed on the second component and the case where another layer is interposed between the first component and the second component.

Figure 6:
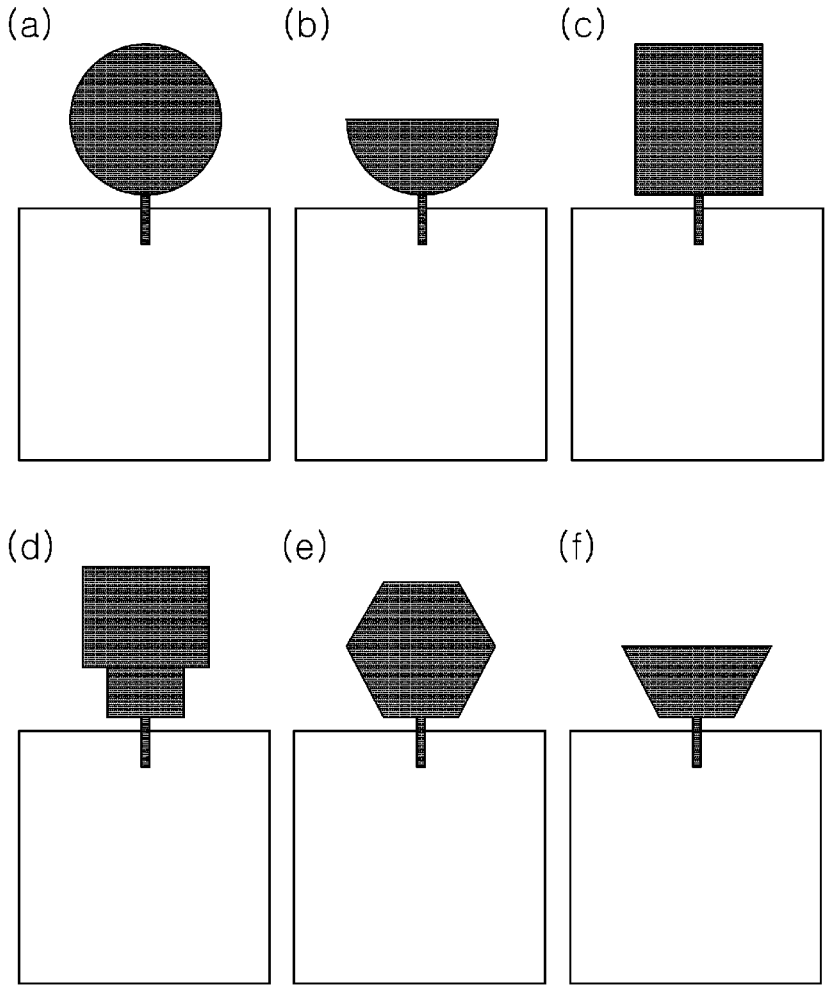
FIG. 6 illustrates an example of a shape of a first radiator applicable to an antenna device according to an embodiment.

The first radiator 120 may be configured to cover the first band. The first radiator 120 may be in the shape of a plane. For example, the first radiator 120 may be formed in a circular or polygonal structure. As illustrated in FIGS. 1 and 2, the first radiator 120 may be in the shape of a semicircle. The first radiator 120 may be formed in various shapes as illustrated in FIG. 6. The first radiator 120 may be disposed on the dielectric region 112 of the substrate 110. One end portion of the first radiator 120 may face the ground region 111, and an opposite end portion of the first radiator 120 may face away from the ground region 111. The first radiator 120 may operate as a wideband antenna. The first radiator 120 may be implemented to have the area, and a size of the first radiator 120 may be determined to be proportional to a wavelength of a resonant frequency. For example, the selectivity of the first radiator 120 may be 4 or less. The selectivity of an antenna may be proportional to a center frequency "f" and may be inversely proportional to a bandwidth "B". The first radiator 120 may be designed, for example, to cover about 6 GHz to 8 GHz.

According to an embodiment, the first radiator 120 may be formed in the shape of a semicircle inducing a change in impedance by a distance between the first radiator 120 and the ground region 111 depending on a distance from a feeding point of the first radiator 120. For example, a width of the opposite end portion (e.g., a diameter portion of a semicircle) of the first radiator 120 may be wider than a width of the one end portion (e.g., a point being the farthest from the diameter portion of the semicircle) of the first radiator 120. In this case, because a distance between the first radiator 120 and the ground region 111 increases as a distance between the first radiator 120 and the feeding point increases, a change in impedance may be induced.

Figure 7:
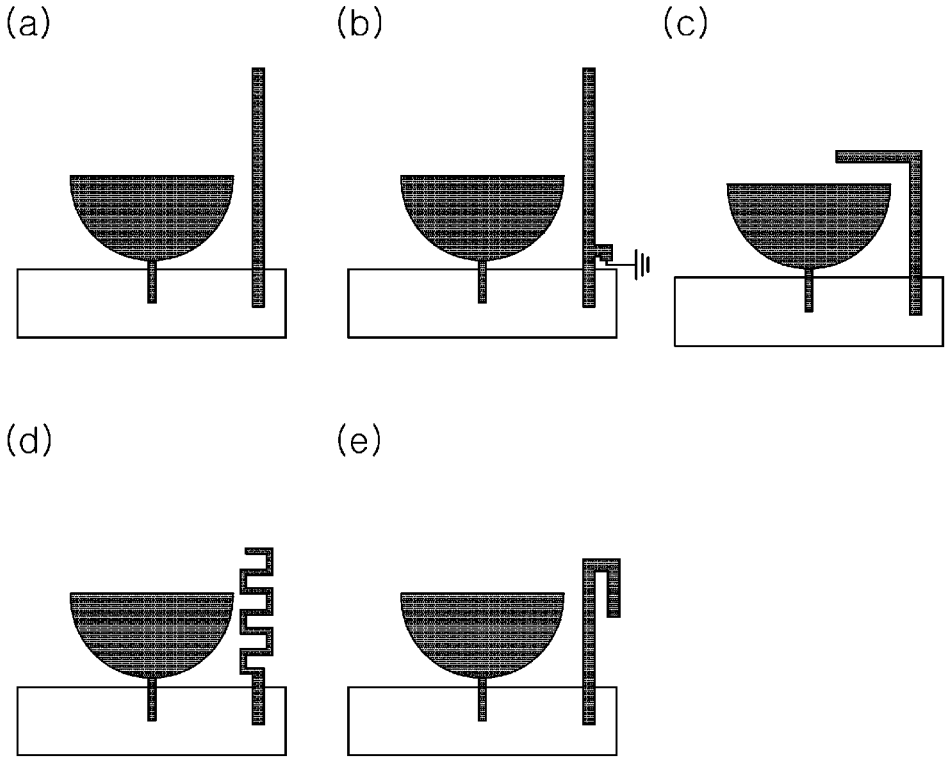
FIG. 7 illustrates an example of a shape of a second radiator applicable to an antenna device according to an embodiment.

The second radiator 130 may be configured to cover the second band. The second radiator 130 may be in the shape of a line. For example, the second radiator 130 may be in the shape of a straight line, a straight line bent one or more times, or a curved line. That is, the first radiator 120 and the second radiator 130 may be different in operation band and outward appearance. As illustrated in FIGS. 1 and 2, the second radiator 130 may be in the shape of a straight line. Alternatively, the second radiator 130 may be in the shape of a line bent one or more times. The second radiator 130 may be formed in various shapes as illustrated in FIG. 7. The second radiator 130 may be disposed on the dielectric region 112 of the substrate 110 so as to be adjacent to the first radiator 120. The second radiator 130 may be disposed on the same plane as the first radiator 120. For example, one end portion of the second radiator 130 may face the ground region 111, and an opposite end portion of the second radiator 130 may face away from the ground region 111. The second radiator 130 may operate as a narrowband antenna. For example, the selectivity of the second radiator 130 may be 30 or less. An operating frequency of the second radiator 130 may be lower than an operating frequency of the first radiator 120. A resonant frequency of the second radiator 130 may be, for example, about 2.4 GHz.

According to an embodiment, the first radiator 120 and the second radiator 130 may operate in a first-order resonant mode and may have an omnidirectional radiation pattern. When one antenna is implemented to cover 2.4 GHz and 6 GHz to 8 GHz, the antenna should operate in an n-order resonant mode (n>1), thereby making it difficult to implement the omnidirectional radiation pattern. Because the antenna device 100 according to an embodiment is implemented such that the first radiator 120 to cover 6 GHz to 8 GHz in the first-order resonant mode and the second radiator 130 covers 2.4 GHz in the first-order resonant mode, the omnidirectional radiation pattern may be implemented. However, in the case of utilizing two radiators adjacent to each other, because the performance of radiation is reduced due to the interference between the radiators, the reduction of radiation performance may be prevented by employing the connecting structure 160.

The first feeding line 140 and the second feeding line 150 may be disposed on the ground region 111. The first feeding line 140 may electrically connect the first radiator 120 and a first port. For example, one end of the first feeding line 140 may be directly connected with the one end portion of the first radiator 120, and an opposite end of the first feeding line 140 may be connected with the first port. The first feeding line 140 may be electrically connected with the communication circuit through the first port. The second feeding line 150 may electrically connect the second radiator 130 and a second port. For example, one end of the second feeding line 150 may be directly connected with the one end portion of the second radiator 130, and an opposite end of the second feeding line 150 may be connected with the second port. The second feeding line 150 may be electrically connected with the communication circuit through the second port.

The connecting structure 160 may be connected with the first radiator 120, the first feeding line 140, the second radiator 130, and the second feeding line 150. The connecting structure 160 may connect the above-described four components with each other through a point where the first radiator 120 and the first feeding line 140 are connected and a point where the second radiator 130 and the second feeding line 150 are connected. The connecting structure 160 may include a first portion 161 and a second portion 162. The first portion 161 of the connecting structure 160 may be directly connected with the first feeding line 140 and the first radiator 120. For example, the first portion 161 may be disposed on a lower (or bottom) surface of the dielectric region 112, and one end of the first portion 161 may be connected with the one end of the first feeding line 140 and the one end portion of the first radiator 120 through a via. The first portion 161 of the connecting structure 160 may be disposed in parallel with the first feeding line 140. The second portion 162 of the connecting structure 160 may be directly connected with the second radiator 130. The second portion 162 may be disposed on the lower surface of the dielectric region 112 so as to be connected with the opposite end of the first portion 161. One end of the second portion 162 may be directly connected with the opposite end of the first portion 161. An opposite end of the second portion 162 may be directly connected with one point (or the one end portion of the second radiator 130) of the second radiator 130 through a via. The second portion 162 may be disposed perpendicular to the first portion 161. The connecting structure 160 may be, for example, in the shape of inverted-L.

According to an embodiment, when viewed from above an upper (or top) surface of the substrate 110, a portion of the connecting structure 160 may overlap the first radiator 120. For example, the first radiator 120 may be disposed on the upper surface of the substrate 110, and the connecting structure 160 may be disposed on the lower surface of the substrate 110. The antenna device 100 may be miniaturized by designing the first radiator 120 and the connecting structure 160 so as to overlap each other.

According to an embodiment, a length of the connecting structure 160 may be ¼ or more of a guided wavelength λg corresponding to a resonant frequency of the second radiator 130 and a relative dielectric constant of a dielectric (i.e., the dielectric region 112) contacting the second radiator 130 and may be ¼ or less of a wavelength 2 corresponding to a resonant frequency of the second radiator 130. $\lambda=c/f$ (c being a speed of light, and f being a resonant frequency of the second radiator 130), and $\lambda g=\lambda/\sqrt{\varepsilon_r}$ ($\varepsilon_r$ being a relative dielectric constant of a dielectric contacting the second radiator 130). In the case of using the first radiator 120 and the second radiator 130 that are adjacent to each other, the interference may occur due to a current flow distorted between the two radiators 120 and 130. Because adjacent radiators operate as a factor hindering radiation mutually, the performance of the antenna device 100 may be reduced. The interference between two radiators may be prevented by designing a length of the connecting structure 160 within the above-described range.

According to an embodiment, when the radiation is made by the second radiator 130, the connecting structure 160 may operate as an open circuit. When a feeding current corresponding to a resonant frequency of the second radiator 130 is supplied to the second radiator 130, the connecting structure 160 may operate as an open circuit due to the length of the connecting structure 160. When the connecting structure 160 operates as an open circuit, the first radiator 120 may not be affected by the radiation of the second radiator 130. As such, the interference by the first radiator 120 may be prevented when the radiation is made by the second radiator 130.

According to an embodiment, when the radiation is made by the first radiator 120, a feeding current may be transferred to the second radiator 130 through the connecting structure 160 but may be fed back to the first radiator 120 through the connecting structure 160 without the radiation by the second radiator 130. When a feeding current corresponding to a resonant frequency of the first radiator 120 is supplied, the connecting structure 160 may transfer the feeding current to the second radiator 130. In this case, the radiation may not occur at the second radiator 130 due to a frequency of the feeding current, and the feeding current may again be fed back to the first radiator 120 through the connecting structure 160 without loss. Accordingly, a decrease in efficiency and interference by the first radiator 120 may be prevented when the radiation is made by the first radiator 120.

Figure 3:
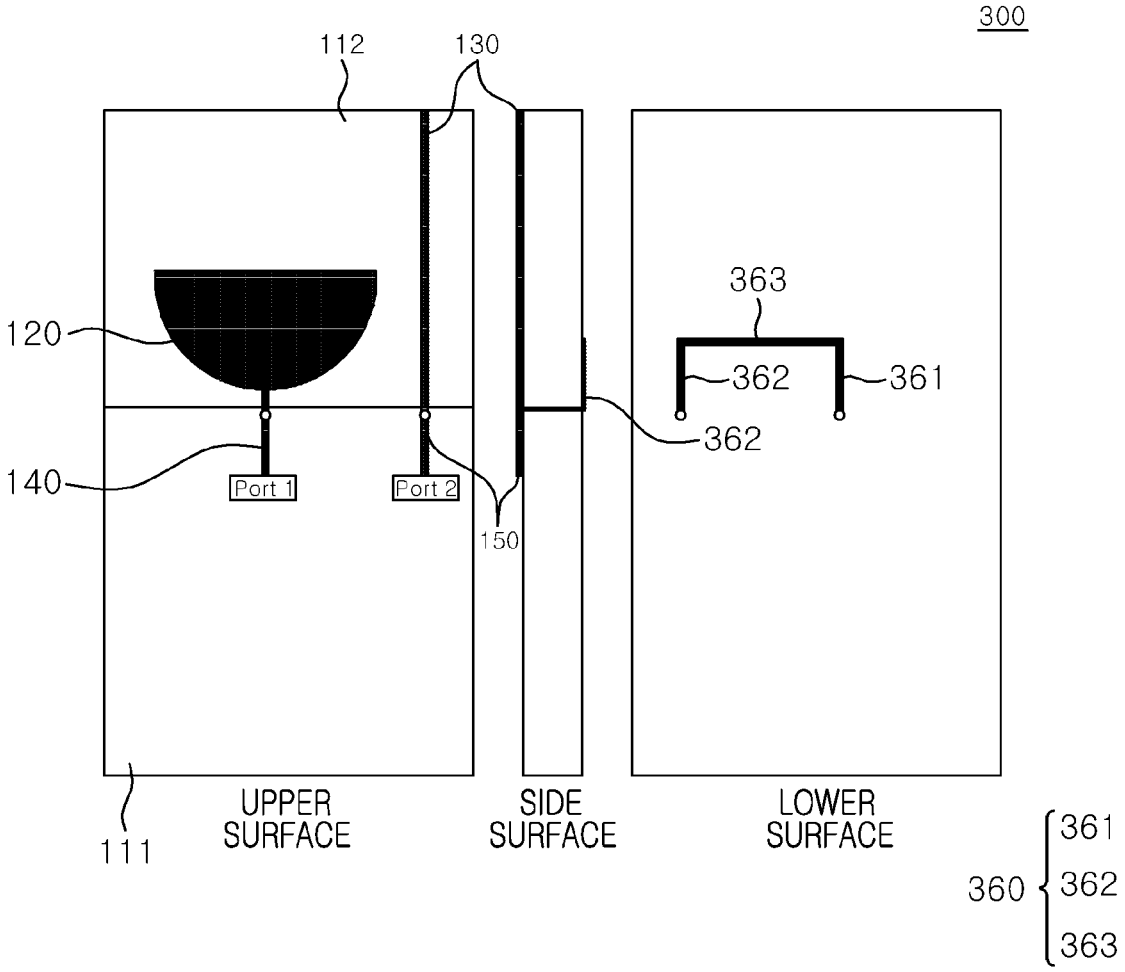
FIG. 3 is a view illustrating a front surface and a side surface of an antenna device according to an embodiment.

FIG. 3 is a view illustrating a front surface and a side surface of an antenna device according to an embodiment.

Referring to FIG. 3, an antenna device 300 including a wideband antenna radiator and a narrowband antenna radiator according to an embodiment may include the substrate 110, the first radiator 120, the second radiator 130, the first feeding line 140, the second feeding line 150, and a connecting structure 360. For convenience of description, additional description associated with the above components will be omitted to avoid redundancy.

The connecting structure 360 may be connected with the first radiator 120, the first feeding line 140, the second radiator 130, and the second feeding line 150. The connecting structure 360 may connect the above-described four components with each other through a point where the first radiator 120 and the first feeding line 140 are connected and a point where the second radiator 130 and the second feeding line 150 are connected. The connecting structure 360 may include a first portion 361, a second portion 362, and a third portion 363. The first portion 361 of the connecting structure 360 may be directly connected with the first feeding line 140 and the first radiator 120. For example, the first portion 361 may be disposed on the lower surface of the dielectric region 112, and one end of the first portion 361 may be connected with the one end of the first feeding line 140 and the one end portion of the first radiator 120 through a via. The first portion 361 may be disposed parallel to the first feeding line 140. The second portion 362 of the connecting structure 360 may be connected with the second feeding line 150 and the second radiator 130. The second portion 362 may be disposed on the lower surface of the dielectric region 112, and one end of the second portion 362 may be connected with the one end of the second feeding line 150 and the one end portion of the second radiator 130 through a via. The second portion 362 may be disposed parallel to the first portion 361 and the second feeding line 150. The third portion 363 of the connecting structure 360 may electrically connect the first radiator 120 and the second radiator 130. The third portion 363 may be disposed on the lower surface of the dielectric region 112 so as to connect an opposite end of the first portion 361 and an opposite end of the second portion 362. The third portion 363 may be disposed perpendicular to the first portion 361 and the second portion 362. The connecting structure 360 may be, for example, in the shape of inverted-U.

According to an embodiment, when viewed from above the upper surface of the substrate 110, a portion of the connecting structure 360 may overlap the first radiator 120. For example, the first radiator 120 may be disposed on the upper surface of the substrate 110, and the connecting structure 360 may be disposed on the lower surface of the substrate 110. The antenna device 100 may be miniaturized by designing the first radiator 120 and the connecting structure 360 so as to overlap each other.

According to an embodiment, a length of the connecting structure 360 may be ¼ or more of a guided wavelength $\lambda g$ corresponding to a resonant frequency of the second radiator 130 and a relative dielectric constant of a dielectric (i.e., the dielectric region 112) contacting the second radiator 130 and may be ¼ or less of a wavelength $\lambda$ corresponding to a resonant frequency of the second radiator 130. The interference between two radiators may be prevented by designing a length of the connecting structure 360 within the above-described range.

Figure 4:
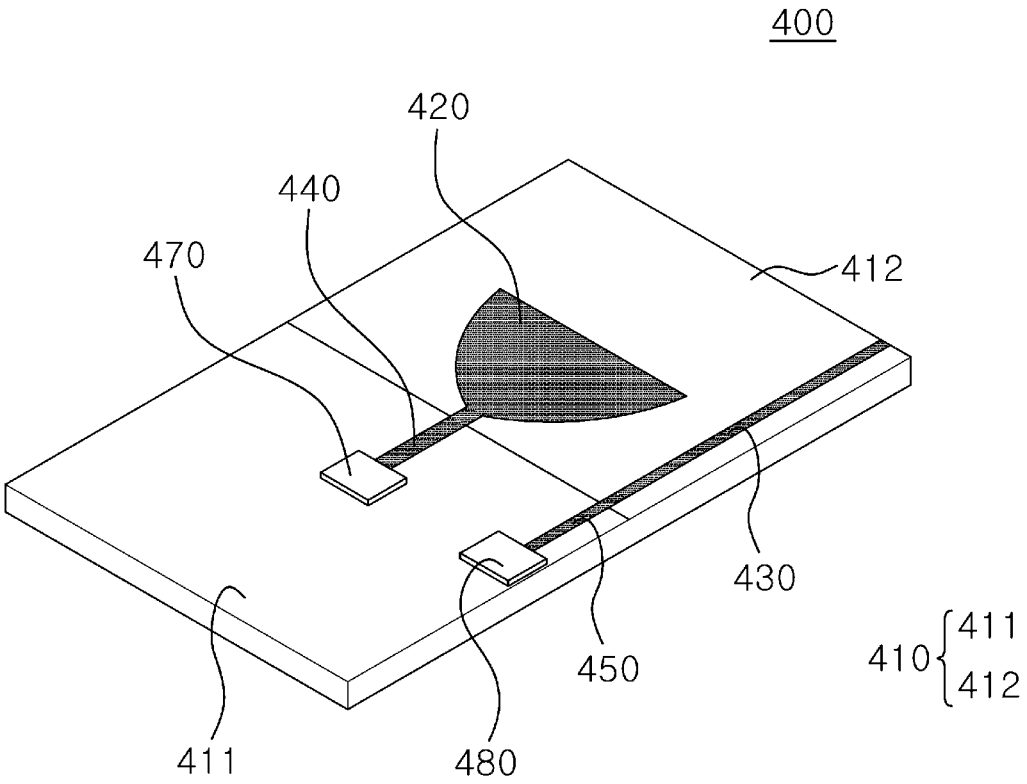
FIG. 4 is a perspective view of an antenna device according to an embodiment.

FIG. 4 is a perspective view of an antenna device according to an embodiment.

Referring to FIG. 4, an antenna device 400 according to an embodiment may include a substrate 410, a first radiator 420, a second radiator 430, a first feeding line 440, a second feeding line 450, a connecting structure (not illustrated), a first communication circuit 470, and a second communication circuit 480.

According to an embodiment, the antenna device 400 may include at least one communication circuit 470 or 480. For example, the antenna device 400 may include the first communication circuit 470 electrically connected with the first feeding line 440 and the second communication circuit 480 electrically connected with the second feeding line 450. The first communication circuit 470 may transmit/receive a signal with the first radiator 420, and the second communication circuit 480 may transmit/receive a signal with the second radiator 430.

Figure 5:
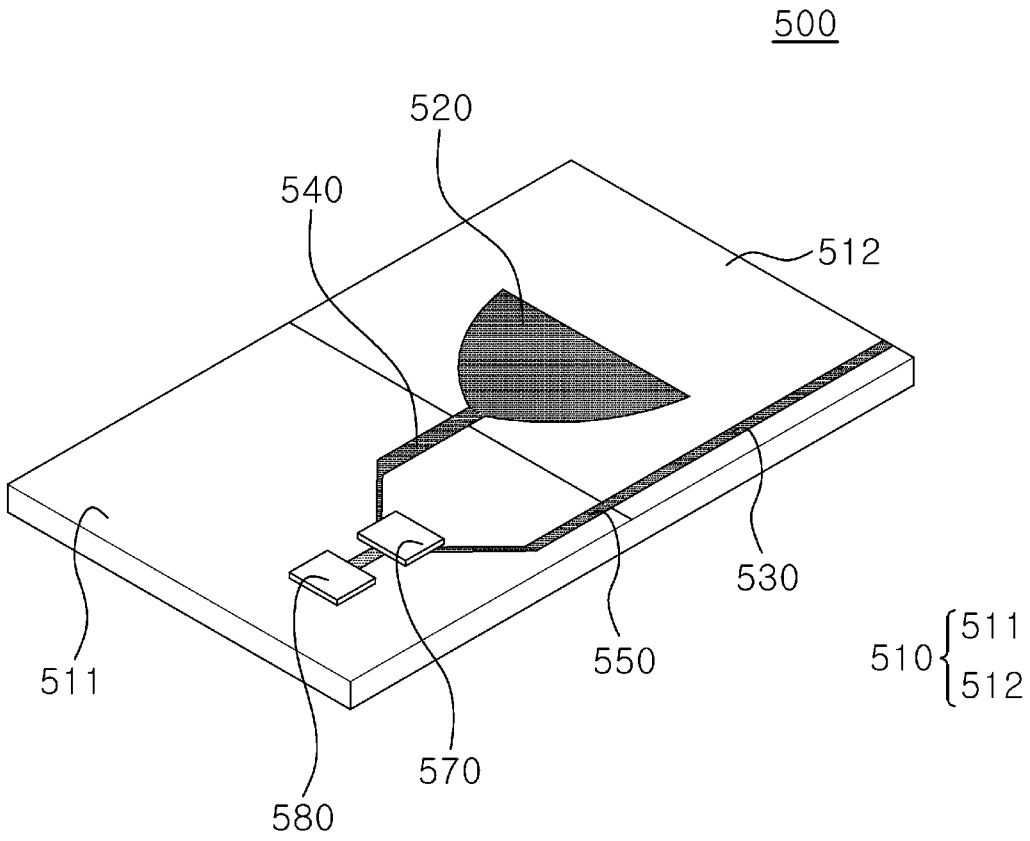
FIG. 5 is a perspective view of an antenna device according to an embodiment.

FIG. 5 is a perspective view of an antenna device according to an embodiment.

Referring to FIG. 5, an antenna device 500 according to an embodiment may include a substrate 510, a first radiator 520, a second radiator 530, a first feeding line 540, a second feeding line 550, a connecting structure (not illustrated), a signal combination circuit 570, and a communication circuit 580.

According to an embodiment, the antenna device 500 may include at least one communication circuit 580. For example, the antenna device 500 may include one communication circuit 580 electrically connected with the first feeding line 540 and the second feeding line 550. In this case, the first feeding line 540 and the second feeding line 550 may be electrically connected with the communication circuit 580 through the signal combination circuit 570 (or a signal splitter (or distributor)) including a diplexer or one or more switches. The communication circuit 580 may transmit/receive signals with the first radiator 520 and the second radiator 530, and the transmitted/received signal may be appropriately distributed by the signal combination circuit 570.

FIG. 6 illustrates an example of a shape of a first radiator applicable to an antenna device according to an embodiment.

Referring to FIG. 6, an antenna device according to an embodiment may include a first radiator that is in the shape of a plane (e.g., a patch) and operates as a wideband antenna. The first radiator may be implemented in various shapes.

For example, as illustrated in FIG. 6, the first radiator may be implemented in various shapes such as a circle (a), a semicircle (b), a rectangle (c), a shape (d) in which two rectangles are combined, a hexagon (e), and an inverted trapezoid (f). To cover a wideband, the first radiator may be designed such that a distance between the first radiator and a ground plane is adjusted depending on a distance from a feeding point and thus a change in impedance is induced. The first radiator may be disposed such that an end portion whose width is relatively narrow is adjacent to a ground region. The first radiator may include a connecting part protruding from a plane-shaped portion for the purpose of connection with a first feeding line.

FIG. 7 illustrates an example of a shape of a second radiator applicable to an antenna device according to an embodiment.

Referring to FIG. 7, an antenna device according to an embodiment may include a second radiator that is in the shape of a line. The second radiator may be in the shape of a straight line or may be in the shape of a line bent one or more times. The second radiator may be disposed adjacent to the first radiator in a lateral direction.

For example, the second radiator may be implemented in various shapes such as a straight line (a), a shape (b) in which an L-shaped flange is coupled to a straight line, an inverted L-shaped shape (c), a meander shape (d), and an inverted J-shaped shape (e). The shape of the second radiator may be variously implemented, but may be in the shape of a line in common. When the second radiator is bent, the miniaturization of the antenna device may be easy.

An example in which the first radiator is in the shape of a semicircle is illustrated in FIG. 7, but the present disclosure is not limited thereto. For example, various shapes of the second radiator illustrated in FIG. 7 may be combined with any one of various shapes of the first radiator illustrated in FIG. 6.

Figure 8:
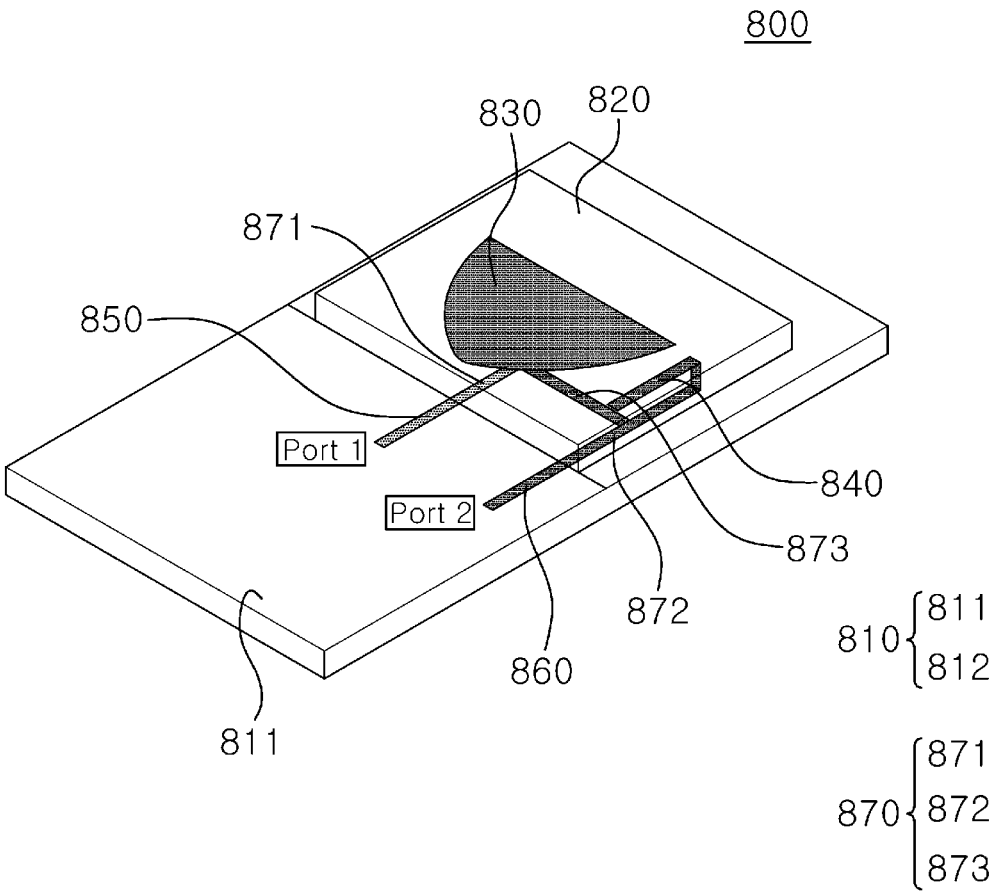
FIG. 8 is a perspective view of an antenna device according to an embodiment.
Figure 9:
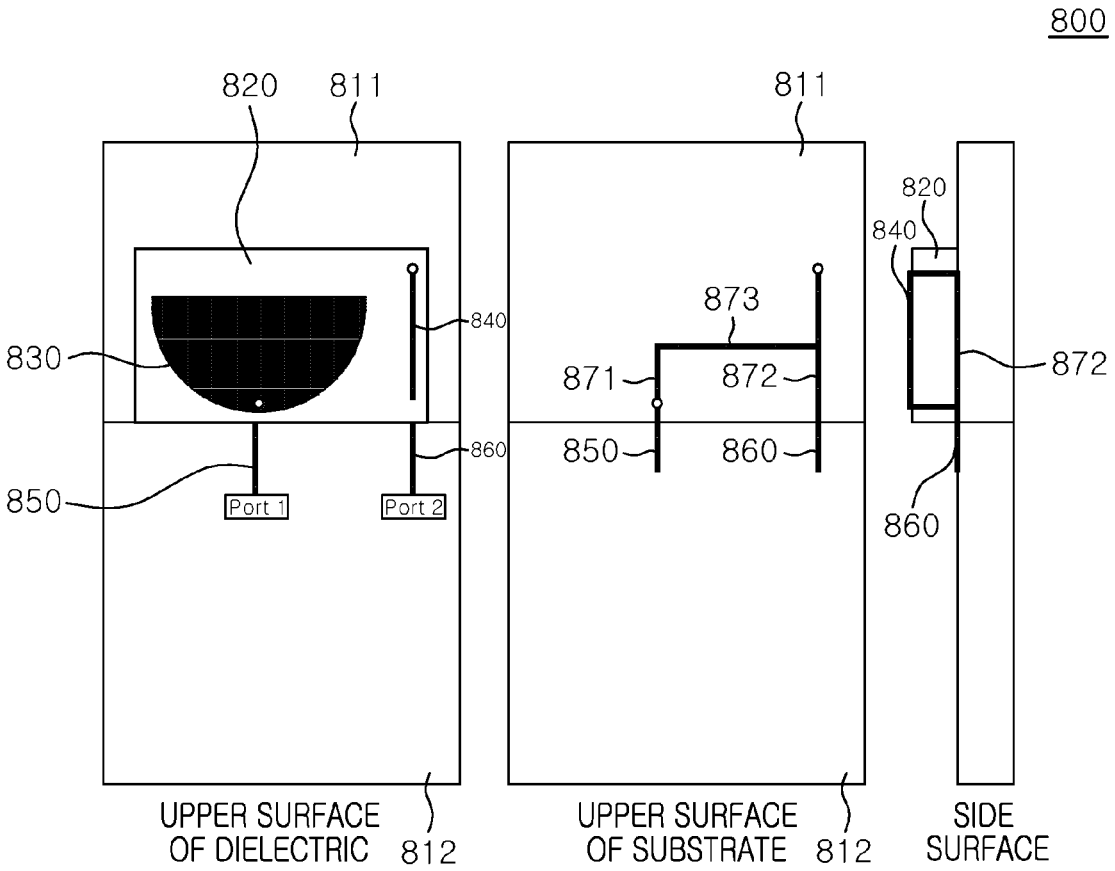
FIG. 9 is a view illustrating a front surface and a side surface of an antenna device according to an embodiment.

FIG. 8 is a perspective view of an antenna device according to an embodiment. FIG. 9 is a view illustrating a front surface and a side surface of an antenna device according to an embodiment.

Referring to FIGS. 8 and 9, an antenna device 800 including a wideband antenna radiator and a narrowband antenna radiator according to an embodiment may include a substrate 810, a dielectric plate 820, a first radiator 830, a second radiator 840, a first feeding line 850, a second feeding line 860, and a connecting structure 870. The antenna device 800 may be implemented to cover the first band and the second band. A frequency of the first band may be higher than a frequency of the second band, the first band may be implemented to be a wide band, and the second band may be implemented to be a narrow band.

The substrate 810 may be in the shape of a plate. For example, the substrate 810 may be rectangular. The substrate 810 may include a ground region 811 and a dielectric region 812. For example, half of the substrate 810 may be formed of the ground region 811, and the other half of the substrate 810 may be formed of the dielectric region 812. The ground region 811 may be formed of a conductor and a dielectric, and the dielectric region 812 may be formed of a dielectric without a conductor. The first feeding line 850, the second feeding line 860, a communication circuit (not illustrated), and the like may be disposed on the ground region 811, and the first radiator 830, the second radiator 840, and the connecting structure 870, and the like may be disposed on the dielectric region 812.

The dielectric plate 820 may be in the shape of a plate. The dielectric plate 820 may be disposed on the dielectric region 812 of the substrate 810. The dielectric plate 820 may be formed of a material whose dielectric constant is higher than that of the dielectric region 812. An antenna may be more easily miniaturized by using the dielectric plate 820 with the high dielectric constant.

The first radiator 830 may be configured to cover the first band. The first radiator 830 may be in the shape of a plane. For example, the first radiator 830 may be formed in a circular or polygonal structure. As illustrated in FIG. 8, the first radiator 120 may be in the shape of a semicircle. The first radiator 830 may be disposed on the dielectric plate 820. One end portion of the first radiator 830 may face the ground region 811, and an opposite end portion of the first radiator 830 may face away from the ground region 811. The first radiator 830 may operate as a wideband antenna. The first radiator 830 may be implemented to have the area, and a size of the first radiator 830 may be determined to be proportional to a wavelength of a resonant frequency. For example, the selectivity of the first radiator 830 may be 4 or less. The first radiator 830 may be designed, for example, to cover about 6 GHz to 8 GHz.

The second radiator 840 may be configured to cover the second band. The second radiator 840 may be in the shape of a line. For example, the second radiator 840 may be in the shape of a straight line, a straight line bent one or more times, or a curved line. As illustrated in FIG. 8, the second radiator 840 may be in the shape of a straight line. Alternatively, the second radiator 840 may be in the shape of a line bent one or more times. The second radiator 840 may be disposed on the dielectric plate 820 so as to be adjacent to the first radiator 830. The second radiator 840 may be disposed on the same plane as the first radiator 830. For example, one end portion of the second radiator 840 may face the ground region 811, and an opposite end portion of the second radiator 840 may face away from the ground region 811. The second radiator 840 may operate as a narrowband antenna. For example, the selectivity of the second radiator 840 may be 30 or less. An operating frequency of the second radiator 840 may be lower than an operating frequency of the first radiator 830. A resonant frequency of the second radiator 840 may be, for example, about 2.4 GHz.

The first feeding line 850 and the second feeding line 860 may be disposed on the ground region 811. The first feeding line 850 may be electrically connected with a first port and may be disposed adjacent to the first radiator 830. The first feeding line 850 may be electrically connected with the communication circuit through the first port. The second feeding line 860 may be electrically connected with a second port and may be disposed adjacent to the second radiator 840. The second feeding line 860 may be electrically connected with the communication circuit through the second port.

The connecting structure 870 may be connected with the first radiator 830, the first feeding line 850, the second radiator 840, and the second feeding line 860. The connecting structure 870 may include a first portion 871, a second portion 872, and a third portion 873. The first portion 871 of the connecting structure 870 may electrically connect the first feeding line 850 and the first radiator 830. For example, the first portion 871 may be interposed between the dielectric plate 820 and the substrate 810; one end of the first portion 871 may be directly connected with the one end of the first feeding line 850; one point of the first portion 871 (or an opposite end of the first portion 871) may be directly connected with one point of the first radiator 830 through a via. The first portion 871 may be disposed to extend from the first feeding line 850 in the same direction as the first feeding line 850. The second portion 872 of the connecting structure 870 may electrically connect the second feeding line 860 and the second radiator 840. The second portion 872 may be interposed between the dielectric plate 820 and the substrate 810; one end of the second portion 872 may be directly connected with the one end of the second feeding line 860; an opposite end of the second portion 872 may be directly connected with one point of the second radiator 840 (e.g., one upper end of the second radiator 840 as illustrated in FIG. 8) through a via. The second portion 872 may be disposed parallel to the first portion 871 and may be disposed to extend from the second feeding line 860 in the same direction as the second feeding line 860. The third portion 873 of the connecting structure 870 may electrically connect the first radiator 830 and the second radiator 840. The third portion 873 may be interposed between the dielectric plate 820 and the substrate 810 so as to be connected with an opposite end of the first portion 871 and one point of the second portion 872. One end of the third portion 873 may be connected with the first radiator 830 through a via, and an opposite end of the third portion 873 may be electrically connected with the second radiator 840 through the second portion 872. The third portion 873 may be disposed perpendicular to the first portion 871 and the second portion 872. The connecting structure 870 may be, for example, in the shape of "h".

According to an embodiment, when viewed from above the upper surface of the substrate 810, a portion of the connecting structure 870 may overlap the first radiator 830. For example, the first radiator 830 may be disposed on the upper surface of the dielectric plate 820, and the connecting structure 870 may be interposed between the dielectric plate 820 and the substrate 810. The antenna device 800 may be miniaturized by designing the first radiator 830 and the connecting structure 870 so as to overlap each other.

According to an embodiment, a length of the connecting structure 870 may be ¼ or more of a guided wavelength λg corresponding to a resonant frequency of the second radiator 840 and a relative dielectric constant of a dielectric (i.e., the dielectric plate 820) contacting the second radiator 840 and may be ¼ or less of a wavelength λ corresponding to a resonant frequency of the second radiator 840. The interference between two radiators may be prevented by designing a length of the connecting structure 870 within the above-described range.

According to an embodiment, the antenna device 800 may include at least one communication circuit. For example, the antenna device 800 may include a first communication circuit electrically connected with the first feeding line 850 and a second communication circuit electrically connected with the second feeding line 860. For another example, the antenna device 800 may include one communication circuit electrically connected with the first feeding line 850 and the second feeding line 860.

Figure 10A:
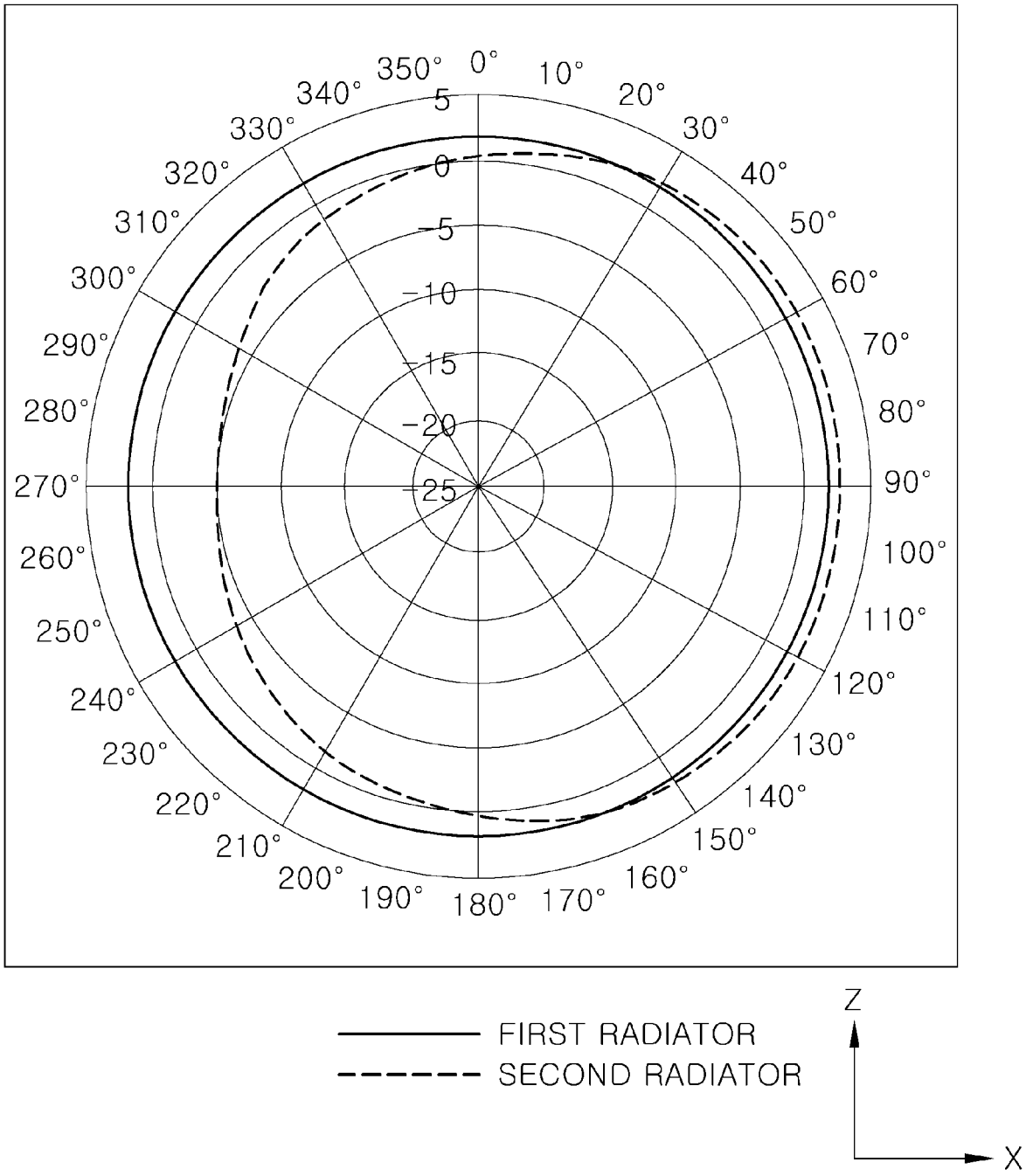
FIG. 10A illustrates an example of a radiation pattern formed by an antenna device according to an embodiment.
Figure 10B:
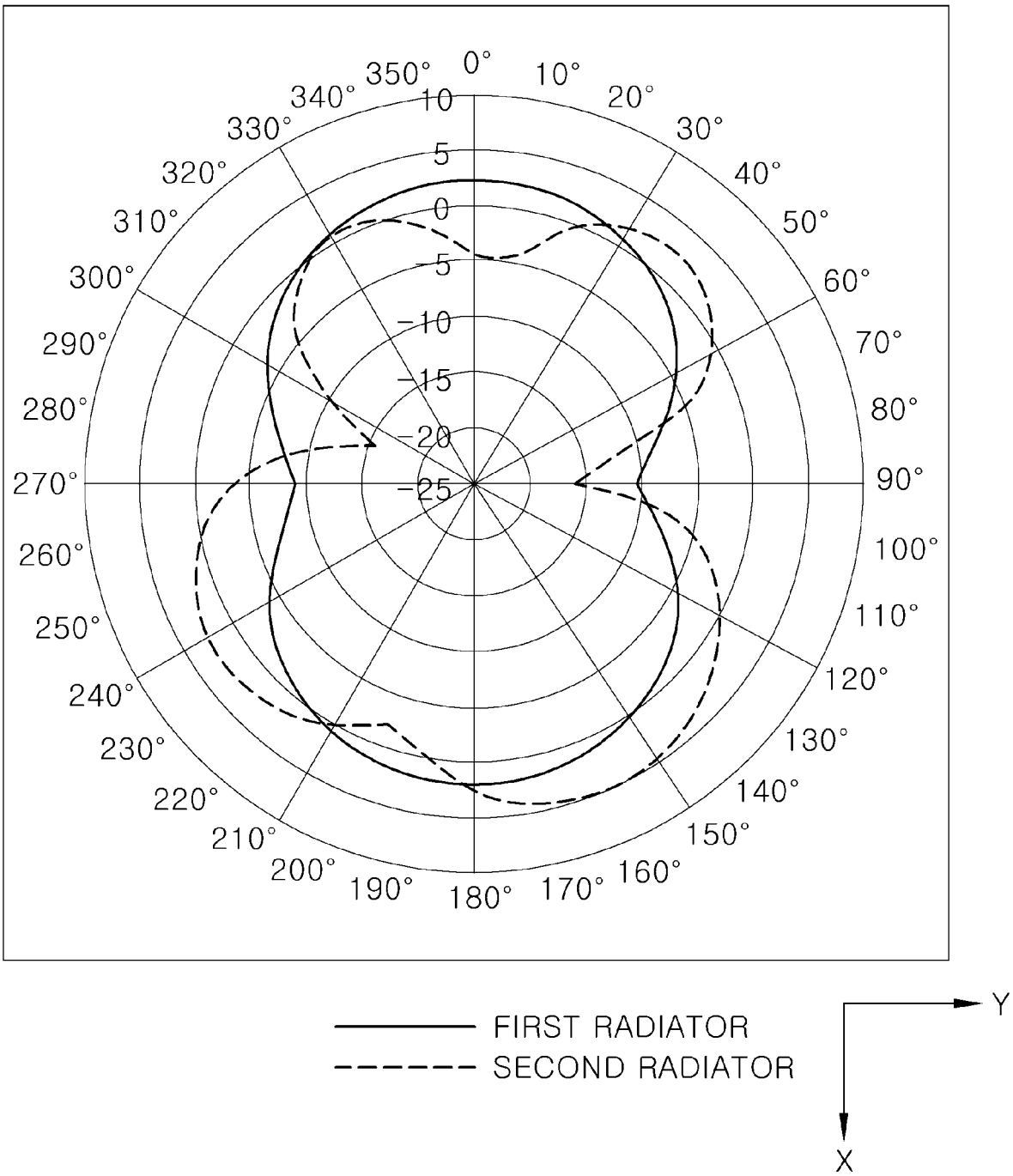
FIG. 10B illustrates an example of a radiation pattern formed by an antenna device according to an embodiment.

FIGS. 10A and 10B illustrate examples of a radiation pattern formed by an antenna device according to an embodiment.

Referring to FIGS. 10A and 10B, a first radiator and a second radiator included in an antenna device according to an embodiment may operate in the first-order resonant mode and may form an omnidirectional radiation pattern. FIG. 10A illustrates a radiation pattern of the first radiator and the second radiator on an XZ plane (e.g., a plane perpendicular to the substrate and the second radiator, in FIG. 1), and FIG. 10B illustrates a radiation pattern of the first radiator and the second radiator on an XY plane (e.g., a plane on which the substrate is placed, in FIG. 1). In graphs, a solid line indicates a radiation pattern of the first radiator, and a dashed line indicates a radiation pattern of the second radiator.

Referring to FIGS. 10A and 10B, it may be confirmed that an omnidirectional radiation pattern is formed in the bands that the first radiator and the second radiator support. In particular, referring to FIG. 10A, it may be confirmed that an omnidirectional radiation pattern close to a circle is formed by both the first radiator and the second radiator on the XZ plane.

Accordingly, those of ordinary skill in the art will recognize that modification, equivalent, and/or alternative on the various embodiments described herein can be variously made without departing from the scope and spirit of the present disclosure. With regard to the description of drawings, similar components may be marked by similar reference marks/numerals. The terms of a singular form may include plural forms unless otherwise specified. In the specification, the expressions "A or B", "at least one of A and/or B", "one or more of A and/or B", and the like used herein may include all possible combinations of items listed together. The terms "first", "second", and the like used herein may refer to corresponding components regardless of the order or importance, and may be used to distinguish one component from another component, not intended to limit the corresponding components. When a first component is referred to as being "connected" or "coupled" with a second component, the first component may be directly connected with the second component or may be connected with the second component through any other component.

According to embodiments of the present disclosure, the interference between first and second antenna radiators may be reduced by using a connecting structure for connecting the first and second antenna radiators with two feeding lines.

Also, the performance on interference prevention may be improved by designing a length of the connecting structure in consideration of a resonant frequency of the second radiator.

Besides, a variety of effects directly or indirectly understood through the specification may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An antenna device which includes a wideband antenna radiator and a narrowband antenna radiator, comprising:
   - a substrate including a ground region and a dielectric region;
   - a first radiator being in a plane shape, operating as a wideband antenna, and disposed on the dielectric region such that one end portion faces the ground region and an opposite end portion faces away from the ground region, wherein a width of the opposite end portion is wider than a width of the one end portion;
   - a second radiator being in a line shape, operating as a narrowband antenna and at a lower frequency than the first radiator, and disposed adjacent to the first radiator on the dielectric region such that one end portion faces the ground region and an opposite end portion faces away from the ground region;
   - a first feeding line disposed on the ground region;
   - a second feeding line disposed on the ground region; and
   - a connecting structure connected with the first radiator, the first feeding line, the second radiator, and the second feeding line,
   - wherein the connecting structure operates as an open circuit when radiation is made by the second radiator.

2. The antenna device of claim 1, wherein the first radiator is in a semicircular or semielliptical shape inducing a change in impedance by a distance between the first radiator and the ground region depending on a distance from a feeding point of the first radiator, and wherein the second radiator is in a straight line shape.

3. The antenna device of claim 1, wherein the second radiator is in the shape of a line bent one or more times.

4. The antenna device of claim 1, wherein a selectivity of the first radiator is 4 or less, and wherein a selectivity of the second radiator is 30 or less.

5. The antenna device of claim 1, wherein the first radiator and the second radiator operate in a first-order resonant mode and form an omnidirectional radiation pattern.

6. The antenna device of claim 1, wherein a portion of the connecting structure overlaps the first radiator, when viewed from above an upper surface of the substrate.

7. The antenna device of claim 1, wherein a length of the connecting structure is ¼ or more of a guided wavelength (λg) corresponding to a resonant frequency of the second radiator and a relative dielectric constant of a dielectric contacting the second radiator and is ¼ or less of a wavelength (λ) corresponding to a resonant frequency of the second radiator.

8. The antenna device of claim 1, wherein, when radiation is made by the first radiator, a feeding current is transferred to the second radiator through the connecting structure and is fed back to the first radiator through the connecting structure without radiation by the second radiator.

9. The antenna device of claim 1, further comprising:

a dielectric plate disposed on the dielectric region, wherein a dielectric constant of the dielectric plate is greater than a dielectric constant of the dielectric region, wherein the first radiator and the second radiator are disposed on the dielectric plate, and wherein the connecting structure is interposed between the dielectric region and the dielectric plate.

* * * * *